US008561634B2

(12) United States Patent
Lee et al.

(10) Patent No.: US 8,561,634 B2
(45) Date of Patent: Oct. 22, 2013

(54) SYSTEM AND METHOD FOR DECREASING VOC IN CRUDE OIL TANKER

(75) Inventors: Jung Han Lee, Goeje-si (KR); Jin Yeol Yu, Goeje-si (KR); Dong Kyu Choi, Goeje-si (KR); Young Sik Moon, Goeje-si (KR); Oh Hyun Kwon, Goeje-si (KR)

(73) Assignee: Daewoo Shipbuilding & Marine Engineering Co., Ltd. (KR)

( * ) Notice: Subject to any disclaimer, the term of this patent is extended or adjusted under 35 U.S.C. 154(b) by 363 days.

(21) Appl. No.: 13/003,866

(22) PCT Filed: Jul. 15, 2009

(86) PCT No.: PCT/KR2009/003880
§ 371 (c)(1),
(2), (4) Date: Jan. 12, 2011

(87) PCT Pub. No.: WO2010/008194
PCT Pub. Date: Jan. 21, 2010

(65) Prior Publication Data

US 2011/0108129 A1 May 12, 2011

(30) Foreign Application Priority Data

Jul. 16, 2008 (KR) ..... 10-2008-0069017

(51) Int. Cl.
*F16L 5/00* (2006.01)

(52) U.S. Cl.
USPC ..... 137/372

(58) Field of Classification Search
USPC ..... 137/372
See application file for complete search history.

(56) References Cited

U.S. PATENT DOCUMENTS

| | | | | |
|---|---|---|---|---|
| 4,981,153 | A | 1/1991 | Perkins | |
| 2004/0148963 | A1* | 8/2004 | Lothe | 62/613 |
| 2004/0194844 | A1* | 10/2004 | Lothe | 141/18 |
| 2005/0166982 | A1* | 8/2005 | Lothe | 137/888 |
| 2006/0150638 | A1* | 7/2006 | Lothe | 62/47.1 |
| 2006/0243336 | A1* | 11/2006 | Madariaga | 138/37 |
| 2008/0209918 | A1* | 9/2008 | White | 62/50.1 |

FOREIGN PATENT DOCUMENTS

| | | | |
|---|---|---|---|
| JP | 2005-507486 | A | 3/2005 |
| KR | 10-0603674 | B1 | 7/2006 |

OTHER PUBLICATIONS

International Search Report dated Feb. 22, 2010, for International Application No. PCT/KR2009/003880 (2 pages).

* cited by examiner

*Primary Examiner* — Lore Jarrett
(74) *Attorney, Agent, or Firm* — Knobbe Martens Olson & Bear, LLP

(57) ABSTRACT

A system for decreasing volatile organic compounds (VOC) in a crude oil tanker includes: a supply pipe horizontally installed over a crude oil storage tank of the crude oil tanker and having an end connected to a crude oil storage tank on land; a load pipe vertically connected to a bottom surface of the supply pipe, vertically passing through the crude oil storage tank of the crude oil tanker, and communicating with a lower part of the crude oil storage tank; a distribution pipe horizontally connected to a lower end of the load pipe; and a pressure control unit installed at a lower end portion of the load pipe.

10 Claims, 1 Drawing Sheet

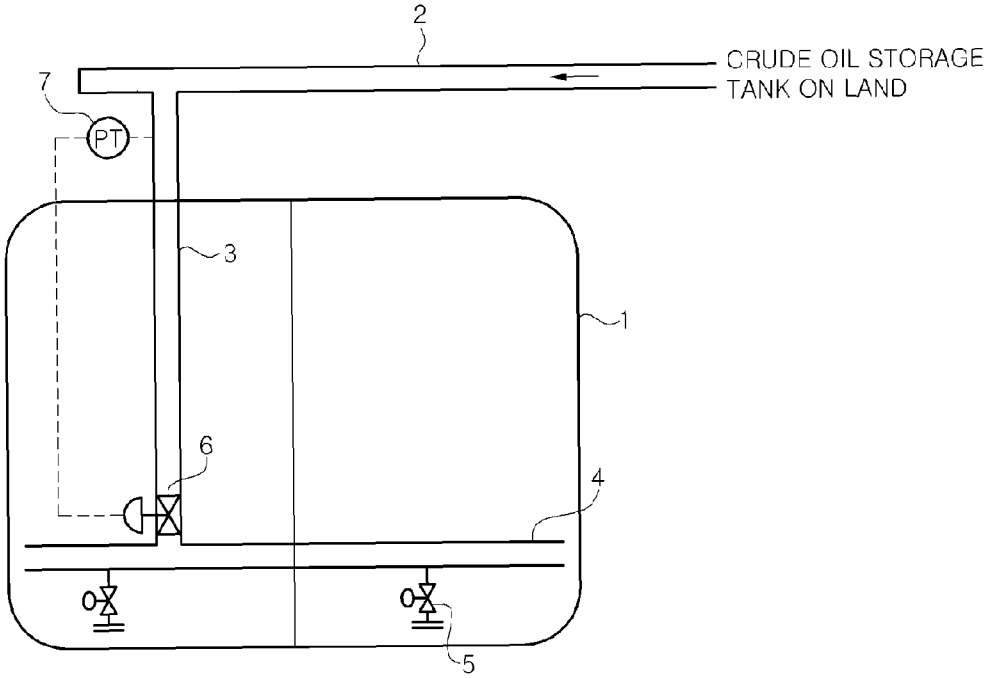
2
CRUDE OIL STORAGE
TANK ON LAND
7
PT
3
1
6
4
5

SYSTEM AND METHOD FOR DECREASING VOC IN CRUDE OIL TANKER

TECHNICAL FIELD

The present invention relates to a system and method for decreasing volatile organic compounds (VOC) in a crude oil tanker, and more particularly, to a system and method for decreasing VOC in a crude oil tanker, which occur while the crude oil tanker is loaded with crude oil.

BACKGROUND ART

In general, crude oil is extracted from an oil field, loaded into a crude oil tanker, and then transported to a destination at a long distance.

In a conventional crude oil tanker, a large amount of VOC occurs while crude oil is loaded into a crude oil storage tank of the crude oil tanker from a crude oil storage tank on land.

In order to supply crude oil to the crude oil storage tank of the crude oil tanker from the crude oil storage tank on the land, a supply pipe is horizontally installed at an upper part of the crude oil tanker, that is, over the crude oil storage tank of the crude oil tanker. The supply pipe has an end connected to the crude oil storage tank on land. In order to load the crude oil, which is supplied from the crude oil storage tank on land through the supply pipe, into the crude oil storage tank of the crude oil tanker, a load pipe is vertically connected to the bottom surface of the supply pipe. The load pipe vertically passes through the crude oil storage tank of the crude oil tanker and communicates with a lower part of the crude oil storage tank of the crude oil tanker. Furthermore, in order to distribute the crude oil, which is loaded into the crude oil storage tank of the crude oil tanker through the load pipe, into the crude oil storage tank of the crude oil tanker, a distribution pipe is installed at a lower end of the load pipe.

When the crude oil meets the vertical load pipe, that is, the upper end part of the load pipe while horizontally supplied from the horizontal supply pipe, the crude oil suddenly falls down. In this case, a flow cavitation may be caused at the upper end part of the load pipe by an excessive pressure drop which occurs while the flow rate of the crude oil increases. That is, when the static pressure of flow inside the load pipe is smaller than the vapor pressure of the flow, a flow cavitation occurs. When the static pressure of the flow is smaller than saturation pressure, flow evaporation occurs. As a result, the crude oil evaporates to generate VOC.

The VOC generated in such a manner are discharged to the air or sent back to the crude oil storage tank on land.

When discharged to the air, the VOC may cause serious environmental problems such as ozone layer damage. Furthermore, although the VOC are sent back to the crude oil storage tank on land, the VOC should be treated. In this case, the facility and cost are required for treating the VOC.

DISCLOSURE

Technical Problem

An embodiment of the present invention is directed to a system and method for decreasing VOC in a crude oil tanker, which is capable of preventing a flow cavitation from occurring at an upper end part of a crude oil load pipe.

Technical Solution

According to an aspect of the present invention, a system for decreasing VOC in a crude oil tanker includes: a supply pipe horizontally installed over a crude oil storage tank of the crude oil tanker and having an end connected to a crude oil storage tank on land; a load pipe vertically connected to a bottom surface of the supply pipe, vertically passing through the crude oil storage tank of the crude oil tanker, and communicating with a lower part of the crude oil storage tank; a distribution pipe horizontally connected to a lower end of the load pipe; and a pressure control unit installed at a lower end portion of the load pipe.

According to another aspect of the present invention, there is provided a method for decreasing VOC in a crude oil tanker, including: supplying and loading crude oil into a crude oil storage tank of the crude oil tanker from a crude oil storage tank on land through a supply pipe horizontally installed over the crude oil storage tank of the crude oil tanker and having an end connected to the crude oil storage tank on land; a load pipe vertically connected to a bottom surface of the supply pipe, vertically passing through the crude oil storage tank of the crude oil tanker, and communicating with a lower part of the crude oil storage tank; and a distribution pipe horizontally connected to a lower end of the load pipe. Pressure inside the load pipe is controlled and maintained to vapor pressure of the crude oil or more.

It should be understood that different embodiments of the invention, including those described under different aspects of the invention, are meant to be generally applicable to all aspects of the invention. Any embodiment may be combined with any other embodiment unless inappropriate. All examples are illustrative and non-limiting.

Advantageous Effects

According to the embodiment of the present invention, the pressure inside the load pipe is controlled at the lower end part of the load pipe and maintained to the vapor pressure of the crude oil or more. Therefore, although the crude oil horizontally-supplied from the horizontal supply pipe suddenly falls down at a portion where the crude oil meets the vertical load pipe, that is, at the upper end part of the load pipe and thus the flow rate of the crude oil increases, a flow cavitation does not occur at the upper end part of the load pipe. That is, when the static pressure of flow inside the load pipe is larger than the vapor pressure of the flow, a flow cavitation does not occur. Therefore, since the crude oil is not evaporated at the upper end part of the load pipe, VOC do not occur.

BRIEF DESCRIPTION OF THE DRAWINGS

FIG. 1 is a schematic view of a system for decreasing VOC in a crude oil tanker according to one embodiment of the present invention.

BEST MODE FOR THE INVENTION

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

FIG. 1 is a schematic view of a system for decreasing VOC in a crude oil tanker according to one embodiment of the present invention.

Referring to FIG. 1, a supply pipe 2 is horizontally installed at an upper part of the crude oil tanker, that is, over a crude oil storage tank 1 of the crude oil tanker. The supply pipe 2 has an end connected to a crude oil storage tank on land such that crude oil is supplied to the crude oil tanker from the crude oil storage tank on land.

Furthermore, a load pipe 3 is vertically connected to the bottom surface of the supply pipe 2. The load pipe 3 vertically passes through the crude storage tank 1 of the crude oil tanker and communicates with a lower part of the crude storage tank 1 of the crude oil tanker. The load pipe 3 is used to load the crude oil, which is supplied through the supply pipe 2 from the crude oil storage tank on land, into the crude oil storage tank 1 of the crude oil tanker.

Furthermore, a distribution pipe 4 is installed at the lower end of the load pipe 3. The distribution pipe 4 is used to distribute the crude oil, which is loaded into the crude oil storage tank 1 of the crude oil tanker through the load pipe 3, into the crude oil storage tank 1 of the crude oil tanker, and the distribution pipe 4 includes a distribution valve 5 installed thereon.

Furthermore, a pressure control valve 6 is installed inside a lower end part of the load pipe 3. The pressure control valve 6 may include an anti-cavitation valve which may be formed by combining a relief valve and a check valve. The anti-cavitation valve is well-known in a valve-related technique field. Therefore, the detailed descriptions thereof will be omitted.

The pressure control valve 6 is connected to a pressure transducer 7 for measuring pressure at the upper end part of the load pipe 3. The pressure control valve 6 controls the pressure inside the load pipe 3 based on the pressure at the upper end part of the load pipe 3, which is transmitted by the pressure transducer 7, and maintains the pressure to the stream pressure of the crude oil or more.

In this embodiment, the pressure inside the load pipe 3 is controlled at the lower end part of the load pipe 3 and maintained to the vapor pressure of the crude oil or more. Therefore, although the crude oil horizontally-supplied from the horizontal supply pipe 2 suddenly falls down at a portion where the crude oil meets the vertical load pipe 3, that is, at the upper end part of the load pipe 3 and thus the flow rate of the crude oil increases, a flow cavitation does not occur at the upper end part of the load pipe 3. That is, when the static pressure of flow inside the load pipe 3 is larger than the vapor pressure of the flow, a flow cavitation does not occur. Therefore, since the crude oil is not evaporated at the upper end part of the load pipe 3, VOC do not occur.

While the present invention has been described with respect to the specific embodiments, it will be apparent to those skilled in the art that various changes and modifications may be made without departing from the spirit and scope of the invention as defined in the following claims.

The invention claimed is:

1. A system for decreasing volatile organic compounds (VOC) in a crude oil tanker, comprising:

a supply pipe extending over a crude oil storage tank of the crude oil tanker, wherein the supply pipe is to be connected to a crude oil storage tank on land;

a load pipe connected to the supply pipe and extending into the crude oil storage tank of the crude oil tanker for transferring crude oil supplied from the supply pipe in a vertical direction;

a distribution pipe connected to a point of the load pipe inside the crude oil storage tank of the crude oil tanker for transferring the crude oil supplied from the load pipe in a horizontal direction to distribute at a plurality of locations inside the crude oil storage tank of the crude oil tanker; and a pressure control unit installed at a lower portion of the load pipe.

2. The system according to claim 1, further comprising a pressure transducer configured to measure pressure at an upper portion of the load pipe and further configured to transmit the measured pressure to the pressure control unit.

3. The system according to claim 2, wherein the pressure control unit comprises an anti-cavitation valve.

4. The system according to claim 1, wherein the pressure control unit comprises an anti-cavitation valve.

5. A method for decreasing VOC in a crude oil tanker, comprising:

loading crude oil into a crude oil storage tank of the crude oil tanker from a crude oil storage tank on land through a supply pipe extending over the crude oil storage tank of the crude oil tanker and connected to the crude oil storage tank on land; a load pipe connected to the supply pipe extending into the crude oil storage tank of the crude oil tanker for transferring crude oil supplied from the supply pipe in a vertical direction; and a distribution pipe connected to a point of the load pipe inside the crude oil storage tank of the crude oil tanker for transferring the crude oil supplied from the load pipe in a horizontal direction to distribute at a plurality of locations inside the crude oil storage tank of the crude oil tanker, wherein the static pressure of flow of the crude oil inside the load pipe is larger than the vapor pressure of flow of the crude oil.

6. The method according to claim 5, wherein the pressure inside the load pipe is controlled by a pressure control unit installed at a lower portion of the load pipe.

7. The method according to claim 6, wherein pressure is measured at an upper portion of the load pipe, and the pressure inside the load pipe is controlled on the basis of the measured pressure.

8. The method according to claim 5, wherein pressure is measured at an upper portion of the load pipe, and the pressure inside the load pipe is controlled on the basis of the measured pressure.

9. A crude oil tanker ship comprising:

a crude oil storage tank installed on the crude oil tanker ship;

a supply pipe extending over the crude oil storage tank and for connecting to a crude oil supply;

a load pipe connected to the supply pipe and extending into the crude oil storage tank for transferring crude oil supplied from the supply pipe in a vertical direction;

a distribution pipe connected to a point of the load pipe inside the crude oil storage tank for transferring crude oil supplied from the load pipe in a horizontal direction to distribute at a plurality of locations inside the crude oil storage tank, wherein as the flow rate of crude oil increases in the load pipe as it moves from the supply pipe to the load pipe, the distribution pipe downstream the load pipe avoids cavitation in an upper end part of the load pipe during transfer of crude oil; and a pressure control unit installed at a lower portion of the load pipe.

10. A method of loading crude oil, the method comprising:

providing a crude oil tanker ship of claim 9;

connecting the supply pipe to a crude oil supply; and transferring crude oil from the crude oil supply to the crude oil tank via the supply pipe, the load pipe and the distribution pipe, wherein as the flow rate of crude oil increases in the load pipe as it moves from the supply pipe to the load pipe, the distribution pipe downstream the load pipe avoids cavitation in the upper end part of the load pipe during transfer of crude oil.

* * * * *